US006638006B2

(12) United States Patent
Selby

(10) Patent No.: US 6,638,006 B2
(45) Date of Patent: Oct. 28, 2003

(54) TURBINE BLADE LOCKING DEVICE

(75) Inventor: Alan L Selby, Ripley (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/046,246

(22) Filed: Jan. 16, 2002

(65) Prior Publication Data

US 2002/0106279 A1 Aug. 8, 2002

(30) Foreign Application Priority Data

Feb. 3, 2001 (GB) ..... 0102757

(51) Int. Cl.[7] ..... F01D 5/32
(52) U.S. Cl. ..... 415/9; 416/220 R
(58) Field of Search ..... 415/9; 416/215, 416/220 R, 204 A, 248

(56) References Cited

U.S. PATENT DOCUMENTS 3,088,708 A * 5/1963 Feinberg ..... 416/215
3,721,506 A * 3/1973 Anderson ..... 416/215
3,954,350 A 5/1976 Zahring
4,106,801 A 8/1978 Neto
4,658,481 A * 4/1987 Seyler et al. ..... 24/704.1
5,087,174 A 2/1992 Shannon et al.
6,312,215 B1 * 11/2001 Walker ..... 415/9

FOREIGN PATENT DOCUMENTS

EP 386876 A 9/1990
GB 2138891 A 10/1984

* cited by examiner

*Primary Examiner*—Ninh H. Nguyen
(74) *Attorney, Agent, or Firm*—W. Warren Taltavull; Manelli, Denison & Selter PLLC

(57) ABSTRACT

A locking device (36) for use in retaining an assembly of rotor blades against movement around a rotor disc on which they are mounted comprises a body member having first and second portions interconnected by a weakened region (66) whereby a force applied to turn the first portion (38) relative to the second portion (40) can cause them to shear apart at said weakened region (66) thereby facilitating release of seized devices to enable blade removal.

20 Claims, 4 Drawing Sheets

TURBINE BLADE LOCKING DEVICE

FIELD OF THE INVENTION

This invention relates to locking devices. More particularly, but not exclusively, the invention relates to locking devices for locking rotary compressor blades to the rotary discs upon which the blades are mounted.

BACKGROUND OF THE INVENTION

In some high pressure axial flow compressors, the blades are retained in circumferential grooves in the rim of the compressor disc. In order to prevent the blades moving around the disc, one or more locking devices are provided in the groove or grooves.

A problem with such locking devices is that the temperatures and stresses experienced in use of a gas turbine engine can result in the locking devices seizing in the groove. During servicing of the engine, it is often necessary to dismantle the compressor, which means that the seized locking devices need to be drilled out which can result in damage to the disc.

SUMMARY OF THE INVENTION

According to one aspect of this invention there is provided a locking device for locking a first article in a recess of a second article, the device being securable in a secured condition in said recess to lock the first article to the second article, the device comprising a weakness, whereby a force can be applied to said locking device to break the device at said weakness to release the device from said secured condition thereby allowing the first article to be removed from the second article.

The preferred embodiment of this invention is particularly suitable for use in preventing circumferential movement of first article, in the form of compressor or turbine blades of a gas turbine engine, around a second article comprising a support member in the form of a disc on which the blades are mounted.

The locking device may include a body member and securing means to secure the locking device to the second article wherein the weakness extends across a region of at least one of the body member and the securing means.

Preferably at least one of the securing means and the body member comprises first and second portions, wherein the weakness extends between the first and second portions of one of the body member and the securing means. The force may be applied to effect relative turning movement of said first portion relative to said second portion to cause the first portion to shear relative to the second portion at said weakness and to separate therefrom.

The body member may define a bore extending therethrough and the securing means may include an elongate member to extend through the bore to engage the second article, thereby securing the locking device against the second article.

In a first embodiment, the body member includes said first and second portions and said weakened region. The securing means may be securable to said body member at said first portion. The elongate member may extend through the region of the bore through the second portion to engage the second article.

The weakened region may extend at least partially around the body member, preferably substantially wholly therearound. The weakened region may define a boundary between the first and second portions and may comprise a groove or concavity.

Alternatively, or in addition, at least a part of the bore through the region of the second portion adjacent the first portion may be wider than the bore extending through the first portion to create the weakened region at the junction of said first and second portions. Preferably, the wider portion of the bore extends from the first portion to the adjacent end of the bore in the second portion.

Conveniently, the securing member is generally cylindrical in configuration and may be in the form of a bolt or a screw, suitably a grub screw.

In a second embodiment, the securing means includes said first and second portions, and said weakness. The first portion may include said elongate member which may extend through the second portion. The second portion is preferably engageable with the body member. The second portion is preferably engageable with the body member. The second portion and the body member may be provided with threads to co-operate with each other. Preferably, the threads on the body member are internal threads within the bore.

The region of weakness may extend at least partially around the securing means, and preferably substantially wholly therearound.

The first portion may be receivable in an indentation in the first article, for example, in a root shroud of an adjacent rotor blade. The first portion is preferably configured and/or sized to enable the first portion to be turned relative to the first article. Conveniently the first portion is of a substantially circular cross-section, or may be any other suitable configuration, for example, triangular or hexagonal, to allow a torque applying device, e.g. a spanner, to be applied thereto to turn the first portion relative to the second portion.

The body member may be shaped to be received in the recess which may be a groove extending circumferentially around said support member. The second article may include flange means extending partially over and spaced from the base of the recess, the second portion of said body member being adapted to engage the flange means when the device is located in the recess and the securing means actuated to lock the device to the second article.

Preferably complementary threads are formed on the part of said bore extending through the body member, and on a corresponding part of the securing means. In the first embodiment, the threaded parts of the bore and of the securing member are on regions thereof which are radially outwardly located in use.

According to another aspect of this invention there is provided a rotor assembly for a gas turbine engine, the rotor assembly including a plurality of rotor blades assembled on a rotor disc, and at least one locking device as described above engaged with a groove in the disc, wherein each rotor blade located adjacent the, or each, locking device defines an indentation to receive a part of the first portion of said body member therein, the indentation being configured and/or sized to allow the first portion to turn relative to the second portion. The indentations of adjacent blades may together define an access aperture for the locking device. Conveniently, the aperture defined by a pair of adjacent blades is substantially circular. In the preferred embodiment, the invention defined in each of said adjacent blades is substantially semi-circular.

BRIEF DESCRIPTION OF THE DRAWINGS

Embodiment of the invention will now be described by way of example only with reference to the accompanying drawings, in which.

DETAILED DESCRIPTION OF THE INVENTION

Figure 1:
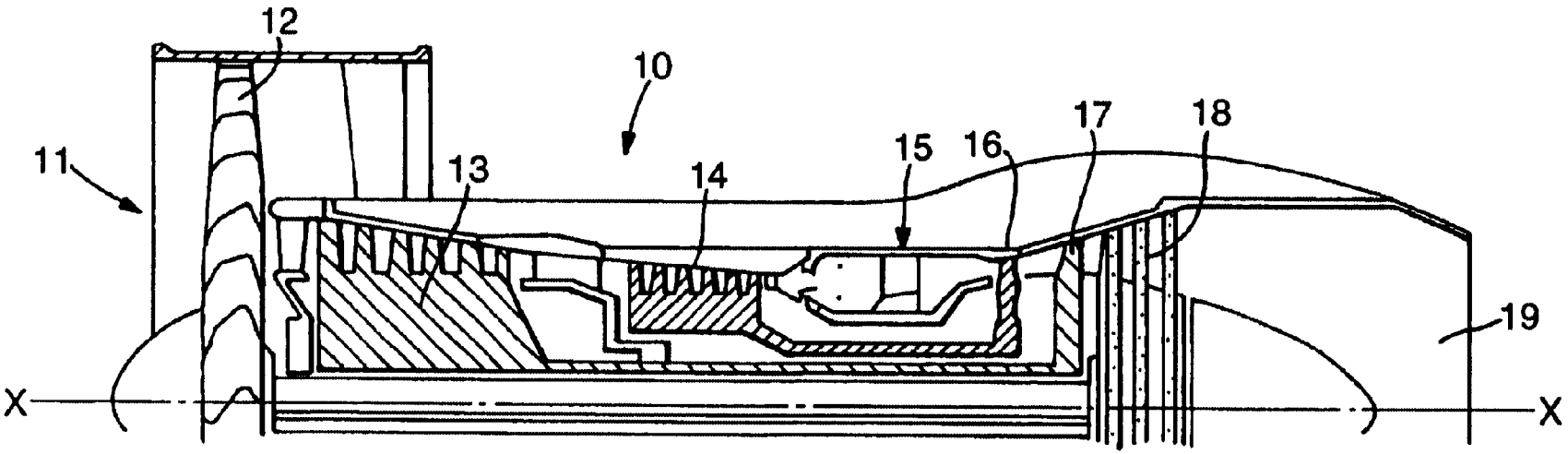
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15 a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression take place.

The compressed air exhausted from the high pressure compressor 14 is directed into the combustor 15 where it is mixed with fuel and the mixture combusted. The resultant hot combustion products then expand through and thereby drive the high, intermediate and low pressure turbines 16, 17 and 18, before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
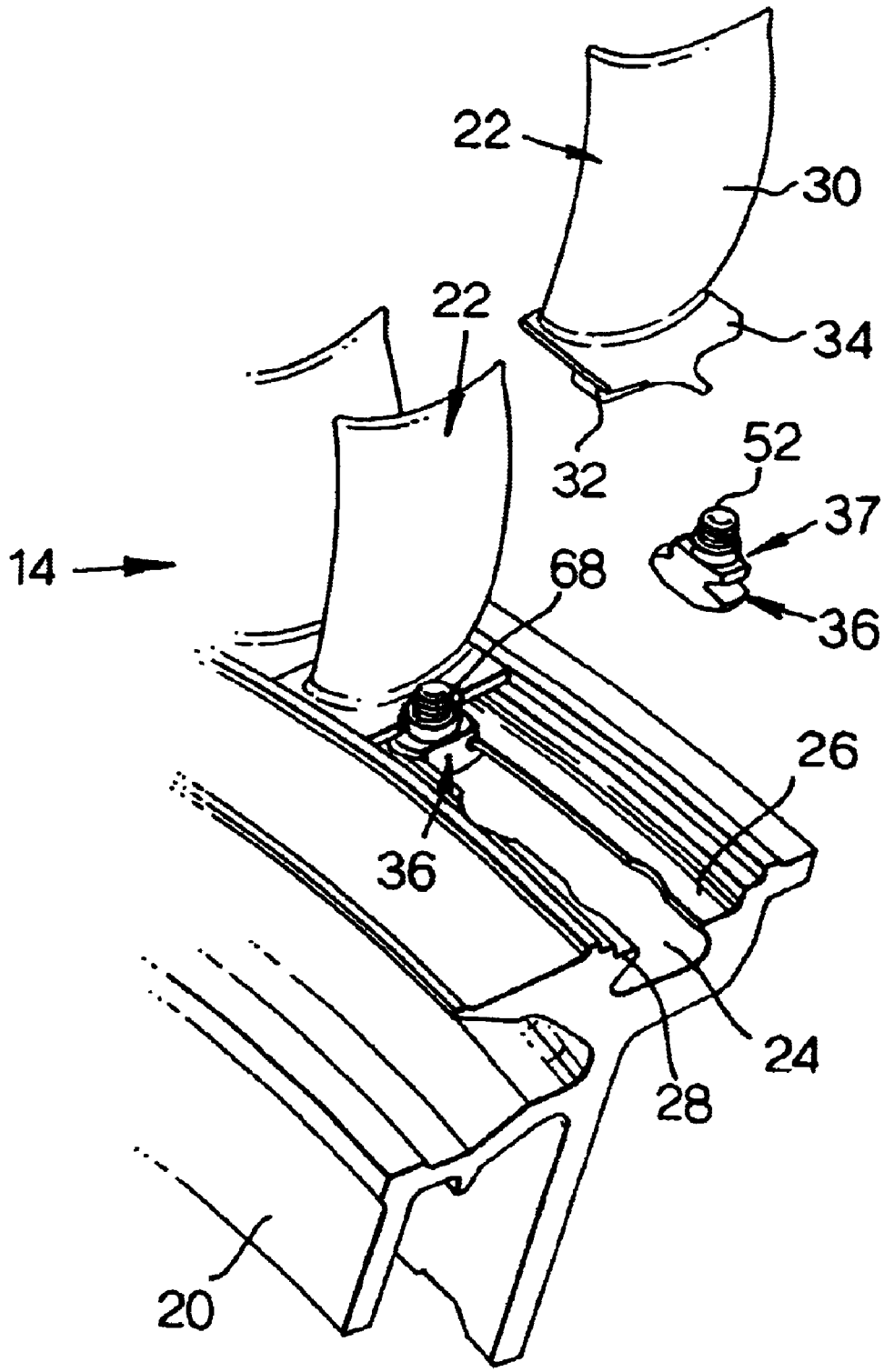
FIG. 2 is a diagrammatic perspective sectional view showing the rotor of a high pressure compressor.

Referring to FIG. 2, there is shown a part of the high pressure compressor 14, which comprises a rotary disc 20 on which are mounted a plurality of compressor blades 22. The disc 20 defines a circumferentially extending groove 24 having opposed flanges 26, 28 to hold the blades 22 on the disc 20.

Each of the blades 22 comprises an aerofoil section 30, a blade root 32 and a root shroud 34 provided between the blade root 32 and the aerofoil section 30.

In order to prevent the compressor blades 22 moving circumferentially around the groove 24, locking devices 36 are provided. Typically, two or more locking devices 36 are provided at spaced intervals around the groove. A first embodiment of a locking device 36 is shown in more detail in FIG. 3 and comprises a body member 37 having first and second portions 38, 40 which define therethrough a bore 42.

The first portion 38 is of a cylindrical configuration, and the second portion 40 is shaped to enable it to be received in the groove 24 and to engage the flanges 26,28. The second portion 40 includes opposite outwardly extending shoulders 44 terminating at a bevelled surface 46. The shoulders 44 are disposed within the generally circular aperture defined by aligned indentations of the root shrouds 34 of selected adjacent blades 22, as explained below. The second portion 40 has a cylindrical surface defining a circular section 47 extending from the each bevelled surface 46. A further bevelled surface 49 extends outwardly from each circular section 47 and corresponds to the shape of the inner surface of the groove 24. The second portion 40 locates the locking device 36 in the groove 24 by engagement with the bevelled inner surface of the groove 24.

The bore 42 has a radially outer end region 48 extending through the first portion 38, which is provided with internal screw threads 50. A securing member, in the form of a bolt or a grub screw 52, has complementary external screw threads 54 formed at its radially outer end region 56 such that the grub screw 52 can be screwed into the bore 42. The radially outer end of the grub screw 52 is provided with a shaped blind recess 53 to receive a suitable driver, for example a hexagonal ended key, or screwdriver (not shown).

The radially inner end of the bore 42 is counterbored to form an increased diameter region 58 extending through the second portion 38. The radially inner shank region 60 of the grub screw 52 which is devoid of screw threads is of lesser diameter than the region 58 such that an annular gap 62 is formed between the shank 60 and the wall of the counterbored region 58 of the bore 42. The gap 62 is large enough to allow the second portion 40 of the body member to fall away from the first portion 38 without hindrance when breakage occurs between the first and second portions 38 and 40 as described hereafter.

An annular concavity 64 is formed around the radially inner end of the first portion 38 adjacent the second portion 40. The concavity 64 and the counterbored region 58 together provide an annular weakened or breakable region 66 extending around the bore 42 between the first and second portions 38, 40.

Referring again to FIG. 2, the compressor 14 is assembled in the normal manner, such that two locking devices 36 are arranged at a predetermined spacing which may be generally opposite each other around the disc 20, conveniently, but not essentially at 180° from each other. The blades 22 are located in the groove 24 in known manner. The blades 22 adjacent, and on opposite sides of, each of the locking devices 36 are provided with root shrouds 32 having indentations 68 defined therein. The two indentations 68 together form a circular aperture in which the first portion 38 of the locking device 36 is received, thereby allowing access thereto by the aforementioned driver.

Figure 3:
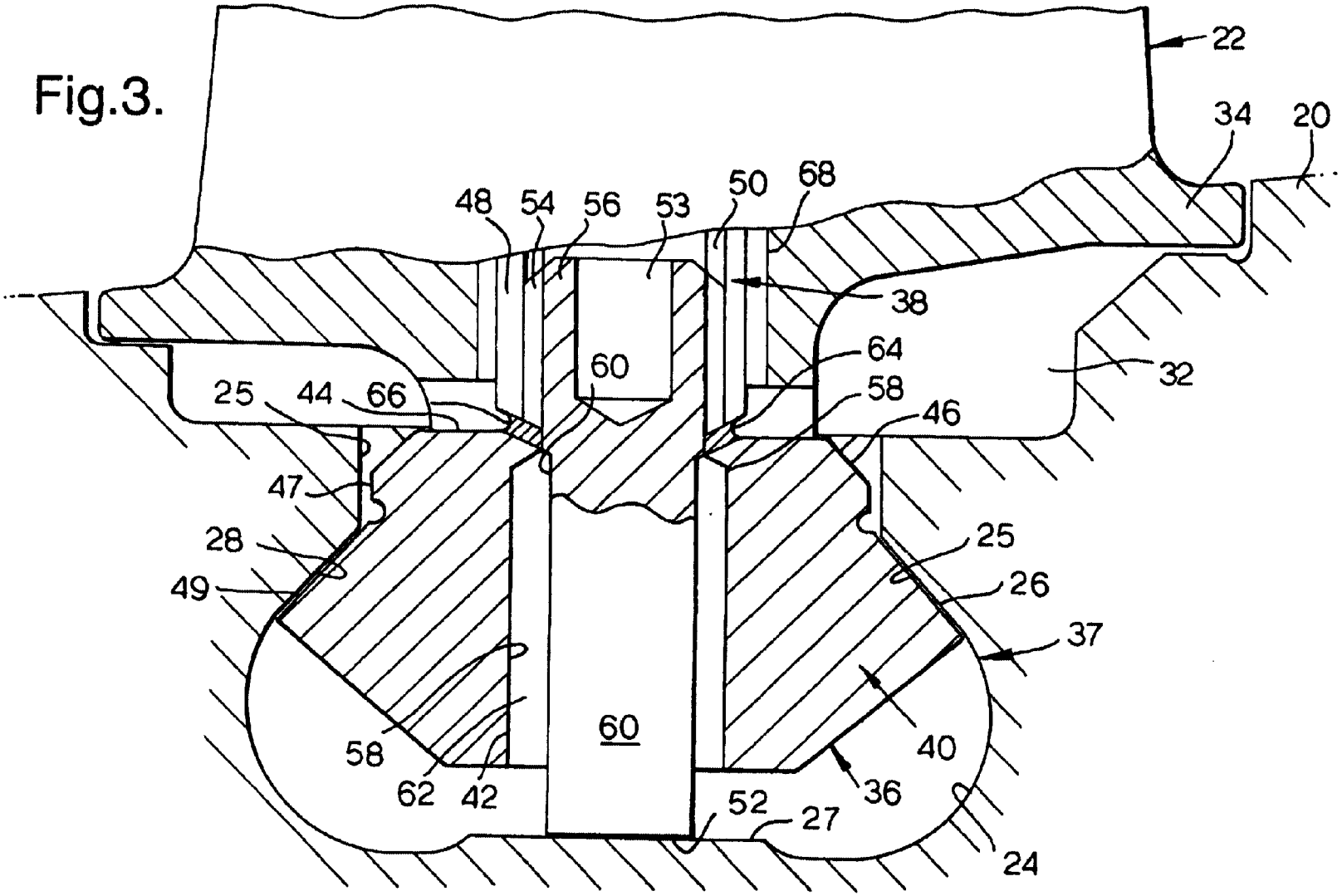
FIG. 3 is a vertical cross-section through one embodiment of a locking device.

In FIG. 3, the locking device 36 is shown within the groove 24 of the disc 20. The groove 24 has shaped side walls 25 which correspond in part to the outwardly extending surface 49 of the second portion 40 of the locking device 36, and a radially inner wall 27 against which the radially inner end of the grub screw 52 can abut.

When all the blades 22 have been fitted in the groove 24, the grub screws 52 are tightened into the threaded region 56 of the respective locking devices 36 and the inner end 55 of each abuts against the radially inner wall 27 of the groove 24. Further tightening of grub screws 52 then pushes the body member 37 radially outwardly until each bevelled wall 46 of the shoulders 44 on the second portion 40 engages against the respective bevelled inner wall 29 of the flanges 26, 28. In this position, the outwardly extending surfaces 49 engage the inner walls 25 of the groove 24. The circular section 47 locates in a circular opening in the groove 24 to prevent circumferential movement of the blades 22 around the disc 20.

When it is desired to dismantle the compressor 14 it is necessary first to remove the locking devices 36. The conditions during use of the compressor 14 frequently cause the grub screws 52 to seize to the inner wall of the bore 42 at threads 50, 54 so that they cannot be removed. However, when the screw 52 is turned the first portion 38 shears relative to the second portion 40 at the weakened region 66. This causes the second portion 40 to break away from the first portion 38 and fall into the groove 24. The first portion 38 can then be removed from the groove 24 of the disc 20 together with the grub screw 52. When this has been repeated for all the locking devices 36 in the groove 24, the blades 22 can be slid around the groove 24 and removed therefrom.

Figure 4:
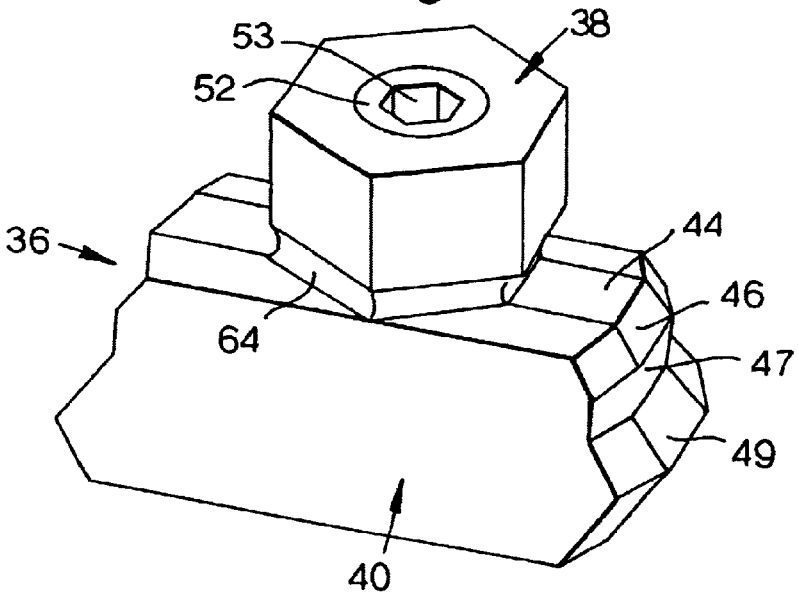
FIG. 4 is a diagrammatic perspective view of a variation of the embodiment shown in FIG. 3.

FIG. 4 shows a variation of the embodiment shown in FIGS. 2 and 3, which differs therefrom in that the first portion 38 is of a hexagonal configuration. This allows a spanner, for example a socket spanner to be fitted over the first portion and a turning force applied thereto to shear the first portion 38 from the second portion 40. It will be appreciated that the first portion 38 can be any suitable configuration to enable a corresponding socket to fit over it to apply the turning force thereto. Further, with this embodiment, the apertures defined by the indentations 68 of adjacent blades 22 is of sufficient size to receive therein a socket of a socket spanner to fit over the first portion 38.

Figure 5:
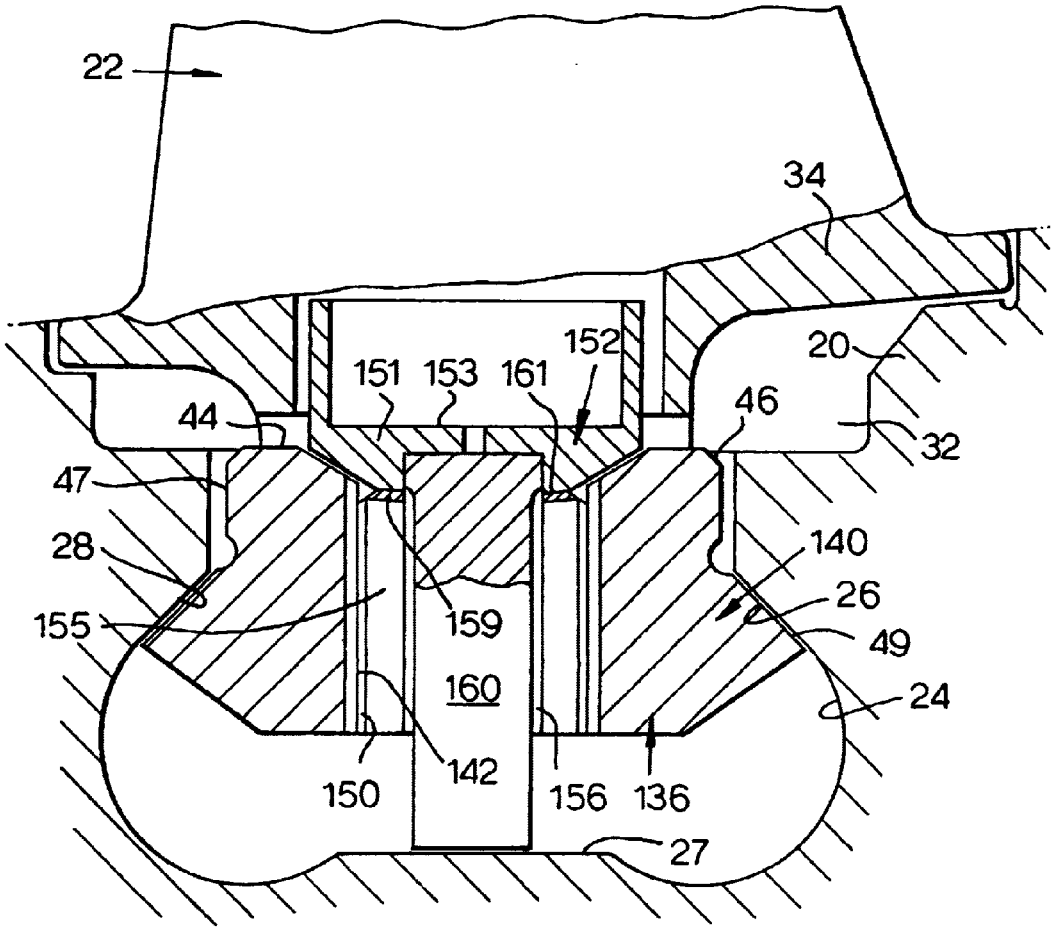
FIG. 5 is a vertical cross-section through a further embodiment of a locking device.

Referring to FIG. 5, there is shown a second embodiment of a locking device 136 which comprises a main body member 140 defining therethrough a bore 142 having internal threads 150.

The body member 140 is of a similar shape to the second portion 40 of the first embodiment, and performs the same function, i.e. it is received in the groove 24 on the rotary disc 20 to secure the compressor blades 22 in place. Accordingly, the body member 140 has many of the same features at the second portion 40 of the first embodiment, and these have been designated with the same reference numeral.

Securing means in the form of a bolt 152 includes a first portion comprising a head 151 having a blind recess 153 shaped to receive a suitable driver, for example a hexagonal ended key or a screwdriver. The bolt 152 also includes a second portion in the form of a shank 155 having external threads 154 which can pivotally engage the threads 150 of the bore 142. The shank 155 defines therein a hollow 156, and an elongate projecting member 160 extends from the head 151 through the hollow 156 in the shank 155 to project from the open end of the shank 155. A V-shaped groove 159 extends around the bolt 152 between the head 151 and the shank 155. The radius of the bolt at the groove 159 is reduced and an annular weakened or breakable region 161 is defined between the groove 159 and the hollow 156.

In use, the elongate member 160 abuts against the radially inner wall 27 of the groove 24 in the disc 20 to push the body member 140 radially outwardly to engage against the flanges 26, 28 of the groove 24 of the compressor disc 20, in the same way as the above screw 52 of the first embodiment.

As can be seen, the elongate member 160 is connected to the head 151 of the bolt 152, but not connected to the shark 155. Thus, in the situation where the bolt 152 is seized to the main body member 140, a turning force applied to the head 151 will cause the head 151 to sheer from the shank 155 at the weakened region 161. Since the elongate member 160 connected to the head 151, the elongate member is removed with the head 151, thereby releasing the body member 140. When the body member 140 has been released, the blades 22 can be removed.

Various modifications may be made without departing from the scope of the invention. For example, alternative means of locking the locking members in place may be employed and the region of weakness in the body member may be formed in different ways and in different locations.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A locking assembly comprising a locking device comprising a weakened region; a first article; a second article comprising a recess; the locking device being securable in a secured condition in the recess to lock the first article to the second article, wherein a force can be applied to the locking device to break the device at the weakened region to release the locking device from the secured condition thereby allowing the first article to be removed from the second article, said locking device including a body member and securing means to secure the locking device to the second article, wherein the weakened region extends across at least one of the body member and the securing means between a portion of the securing means and a portion of the body member and a force applied to effect relative turning movement of the first portion relative to the second portion will cause the first portion to shear relative to the second portion at the weakened region and to separate therefrom.

2. A rotor assembly for a gas turbine engine, the rotor assembly comprising a rotor disc including a groove, a plurality of rotor blades assembled on the rotor disc, at least one locking assembly according to claim 1 engaged with the groove in the rotor disc, at least one rotor blade located adjacent the or each locking device, each such rotor blade defining an indentation, wherein the or each indentation is configured to receive part of the first portion of the locking device, and to allow the first portion to turn relative to the second portion.

3. A gas turbine engine incorporating a rotor assembly according to claim 2.

4. A rotor assembly according to claim 2, wherein the indentations on a pair of adjacent rotor blades define an access aperture for a locking device.

5. A rotor assembly according to claim 4, wherein the access aperture is substantially circular.

6. A rotor assembly for a gas turbine engine comprising a rotor disc and a plurality of rotor blades retained in position on the rotor disc, wherein the rotor blades are retained in position on the rotor disc by one or more locking devices according to claim 1.

7. A gas turbine engine incorporating a rotor assembly according to claim 6.

8. A locking assembly comprising a locking device comprising a weakened region; a first article; a second article comprising a recess; the locking device being securable in a secured condition in the recess to lock the first article to the second article, wherein a force can be applied to the locking device to break the device at the weakened region to release the locking device from the secured condition thereby allowing the first article to be removed from the second article, said locking device including a body member and securing means to secure the locking device to the second article, wherein the weakened region extends across at least one of the body member and the securing means between a portion of the securing means and a portion of the body member and a force applied to effect relative turning movement of the first portion relative to the second portion will cause the first portion to shear relative to the second portion at the weakened region and to separate therefrom member against the second article, wherein the body member defines a bore therethrough and the securing means comprises an elongate member which can extend through the bore to engage the second article, thereby securing the body member against the second article.

9. A locking assembly according to claim 8, wherein the body member comprises the first portion and the second portion and the weakened region, and the securing means are securable to the body member at the first portion, the elongate member extending through the second portion to engage the second article.

10. A locking assembly according to claim 9, wherein the weakened region extends at least partially around the first portion.

11. A locking assembly according to claim 10, wherein the weakened region comprises a groove and defines a boundary between the first portion and the second portion.

12. A locking assembly according to claim 9, wherein at least a part of the bore extending through the region of the second portion adjacent the first portion is wider than the part of the bore extending through the first portion.

13. A locking assembly according to claim 12, wherein the wider part of the bore extends from the first portion to the adjacent end of the bore in the second portion.

14. A locking assembly according to claim 9, wherein the bore includes internal threads at the first portion of the body member and the securing means includes external threads.

15. A locking assembly according to claim 4, wherein the securing means include the first portion and the second portion and the weakened region, the first portion including the elongate member, which extends through the second portion.

16. A locking assembly according to claim 15, wherein the second portion of the securing means is engageable with the body member to fasten the securing means to the body member.

17. A locking assembly according to claim 15 wherein the bore includes internal threads and the second portion of the securing means includes external threads.

18. A locking assembly according to claim 4, wherein the first article includes an indentation, the first portion being receivable in the indentation, and the first portion is configured relative to the indentation to allow the first portion to be turned relative to the second portion.

19. A locking assembly according to claim 18, wherein the first portion is of substantially circular cross-section.

20. A locking assembly according to claim 19, wherein the first portion is configured to enable a torque-applying device to be applied thereto to turn the first portion while the second portion remains substantially fixed.

* * * * *